US009401237B1

(12) United States Patent
Folker et al.

(10) Patent No.: US 9,401,237 B1
(45) Date of Patent: Jul. 26, 2016

(54) CORE PASSAGE STEP APPARATUS AND METHODS

(75) Inventors: Donald Folker, Madison, AL (US); Mike LeBlanc, Huntsville, AL (US); James Neal Van Pelt, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 13/468,237

(22) Filed: May 10, 2012

Related U.S. Application Data

(60) Provisional application No. 61/636,808, filed on Apr. 23, 2012.

(51) Int. Cl.

| | |
|---|---|
| ***H01F 27/30*** | (2006.01) |
| ***H01F 27/08*** | (2006.01) |
| ***H01F 7/06*** | (2006.01) |
| ***H01F 5/02*** | (2006.01) |
| ***H01F 27/32*** | (2006.01) |
| *H01F 41/02* | (2006.01) |

(52) U.S. Cl.
CPC ..... *H01F 5/02* (2013.01); *H01F 27/325* (2013.01); *H01F 27/08* (2013.01); *H01F 41/02* (2013.01)

(58) Field of Classification Search
CPC ..... H01F 27/00; H01F 27/22; H01F 27/325; H01F 41/02; H01F 41/125; H01F 5/02
USPC ..... 336/198, 208, 212, 221, 214, 215, 61; 29/602.1, 606, 607
See application file for complete search history.

(56) References Cited

U.S. PATENT DOCUMENTS

| | | | | |
|---|---|---|---|---|
| 3,354,417 | A * | 11/1967 | Davis | 336/198 |
| 3,525,966 | A * | 8/1970 | Wierzbinski | 336/205 |
| 5,138,545 | A * | 8/1992 | Godawski | 363/68 |
| 5,534,839 | A * | 7/1996 | Mackin et al. | 336/192 |
| 5,977,855 | A * | 11/1999 | Matsumura | H01F 27/365 336/192 |
| 6,154,113 | A * | 11/2000 | Murai | 336/198 |
| 6,771,157 | B2 * | 8/2004 | Nishikawa et al. | 336/178 |
| 6,853,284 | B2 * | 2/2005 | Nagai et al. | 336/83 |
| 6,958,673 | B2 * | 10/2005 | Suzuki | 336/208 |
| 8,022,803 | B2 * | 9/2011 | Park et al. | 336/208 |
| 8,299,886 | B2 * | 10/2012 | Won et al. | 336/221 |
| 2002/0175798 | A1 * | 11/2002 | Sigl | 336/198 |
| 2006/0125590 | A1 * | 6/2006 | Pilniak | H01F 5/02 336/208 |
| 2011/0001598 | A1 * | 1/2011 | Moon et al. | 336/198 |
| 2012/0188044 | A1 * | 7/2012 | Song | 336/192 |

* cited by examiner

*Primary Examiner* — Mangtin Lian
(74) *Attorney, Agent, or Firm* — Patterson Intellectual Property Law, P.C.; Mark J. Patterson; Jerry Turner Sewell

(57) ABSTRACT

A bobbin apparatus for a magnetic component includes a core passage having one or more core passage steps located therein. The core passage steps provide one or more gaps between a core disposed in the core passage and the bobbin body. A potting material may be disposed in the gap or gaps in some applications to enhance heat transfer and/or to improve magnetic component performance by reducing effects of fringing flux on inner windings. A method of assembling a magnetic component to include one or more gaps between the core and bobbin core passage is also provided.

21 Claims, 7 Drawing Sheets

CORE PASSAGE STEP APPARATUS AND METHODS

A portion of the invention of this patent document contains material that is subject to copyright protection. The copyright owner has no objection to the reproduction of the patent document or the patent invention, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic devices for electronic circuits and associated methods of assembly. More particularly, the present invention pertains to bobbin devices for magnetic components with an internal bobbin core passage.

Magnetic components for electronic circuits, including inductors and transformers, are known in the art. Such conventional bobbin-wound components typically include a bobbin around which one or more conductive coils are wound. Conventional bobbins for bobbin-wound magnetic components are often formed with a core passage extending through an axial length of the bobbin. The core passage is generally shaped for receiving an associated core structure such as a portion of conventional ferrite core. Some conventional configurations include opposing E-cores or modified E-cores having an air gap between middle core legs inside the core passage. However, fringing flux associated with the air gap can interact with the inner windings on the bobbin and can create unwanted losses in magnetic component efficiency. Conventional bobbin and core configurations can also lead to increased temperature rise during use, thereby reducing magnetic component performance and requiring undesirable an increase in component size.

What is needed then are improvements in bobbin devices and associated methods for magnetic components.

BRIEF SUMMARY

The present invention in some embodiments provides a bobbin apparatus for a magnetic component. The bobbin apparatus includes a bobbin body having a winding surface and a core passage defined axially through the bobbin body. The bobbin body includes a passage floor substantially facing the core passage. A first passage wall is positioned adjacent the passage floor substantially facing the core passage. A second passage wall is positioned adjacent the passage floor opposite the first passage wall also substantially facing the core passage. A first step is defined between the first passage wall and the passage floor.

In additional embodiments, the present invention provides a magnetic component having a bobbin apparatus as described above and further including a core positioned at least partially in the core passage and including a core leg positioned on the first step, wherein the first step elevates the core leg above the passage floor thereby providing a gap between the core leg and the passage floor.

In further embodiments, a heat transfer material such as a potting material is disposed in the first gap between the core leg and the passage floor, thereby enhancing the performance of the magnetic component.

In an embodiment, the present invention provides a magnetic component apparatus including a bobbin body including a winding surface. A core passage is defined axially through the bobbin body, the core passage defining a core passage interior. A passage floor is formed on the bobbin body substantially facing upwardly toward the core passage interior. A first passage wall is formed on the bobbin body adjacent the passage floor. The first passage wall faces substantially toward the core passage interior. A second passage wall is formed on the bobbin body adjacent the passage floor. The second passage wall is positioned opposite the first passage wall and faces substantially toward the core passage interior. A first step protrudes upwardly from the passage floor a first step height. A second step is disposed on the bobbin body between the passage floor and the second passage wall, the second step protruding upwardly from the passage floor a second step height. A core is positioned in the core passage. A conductive winding is disposed around the winding surface of the bobbin body. A portion of the core rests against the first and second steps.

An object of the present invention is to provide an improved bobbin apparatus for defining gap between a core and an interior surface, such as a core passage floor and/or core passage roof in the bobbin body.

Another object of the present invention is to provide an improved bobbin apparatus and corresponding magnetic component for defining a first gap below a core leg between the core and the bobbin body and also defining a second gap above the core leg between the core and the bobbin body.

Yet another object of the present invention is to provide a method of manufacturing a magnetic component, wherein the method includes positioning a core on a core passage step inside a core passage on a bobbin body, thereby forming a gap between the core and at least one interior wall in the core passage, and filling a heat transfer material at least partially into the gap between the core and the bobbin body.

Numerous other objects, advantages and features of the present invention will be readily apparent to those of skill in the art upon a review of the following drawings and description of a preferred embodiment.

DETAILED DESCRIPTION

Figure 1:
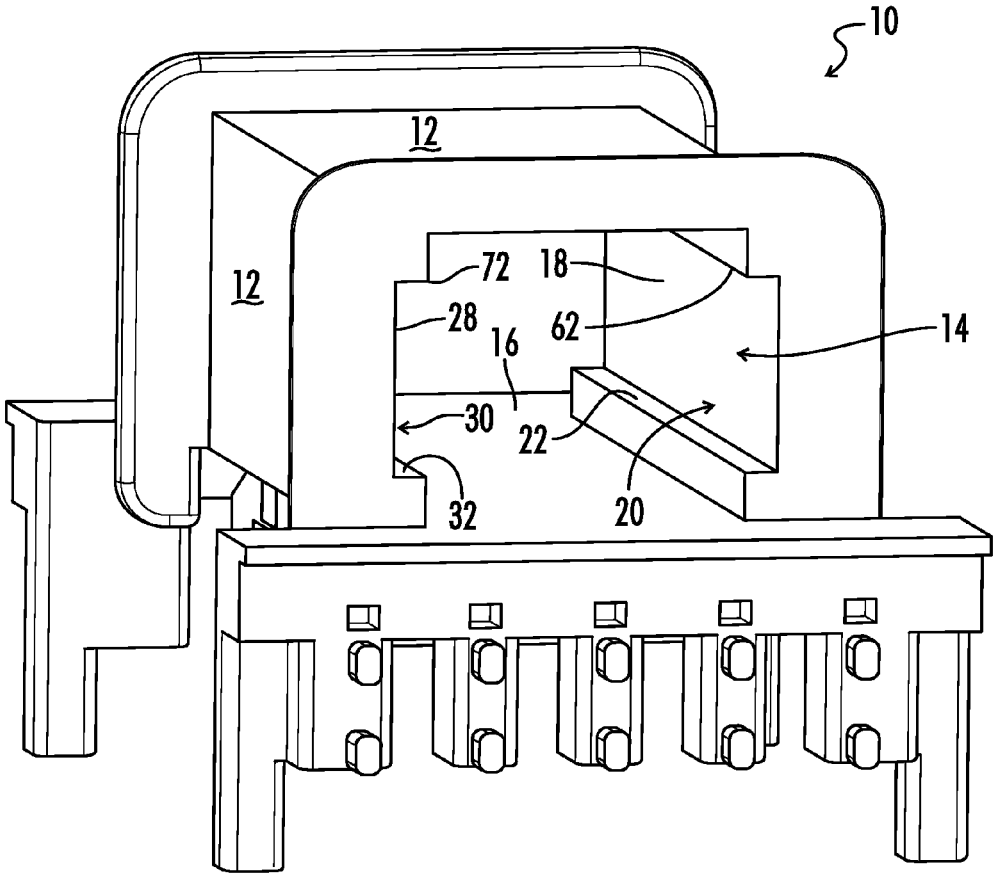
FIG. 1 is a perspective view of an embodiment of a bobbin apparatus including a core passage step in accordance with the present invention.

Referring now to the drawings, FIG. 1 illustrates an embodiment of a bobbin apparatus including a bobbin body 10 having a winding surface 12 thereon. Winding surface 12 may extend around the outer perimeter of bobbin body 10, forming an annular substrate, or coil form, for positioning one or more conductive windings such as electrically conductive primary and/or secondary transformer coils.

Bobbin body 10 includes a core passage 14 defined axially through the bobbin body 10. Core passage 14 includes a hollow passage shaped for receiving one or more core structures such as a ferrite core. Core passage 14 can have a polygonal or a curvilinear cross-sectional profile in various embodiments. For example, in some embodiments, core passage 14 can have a square, rectangular, trapezoidal, circular, oval or other suitable shape corresponding to a portion of an associated core. In some embodiments, core passage 14 may have both polygonal and curvilinear shapes. Core passage 14 in some embodiments has a cross-sectional profile shaped to correspond to a middle core leg on a corresponding ferrite core such as an E-core or a modified E-core.

Figure 2:
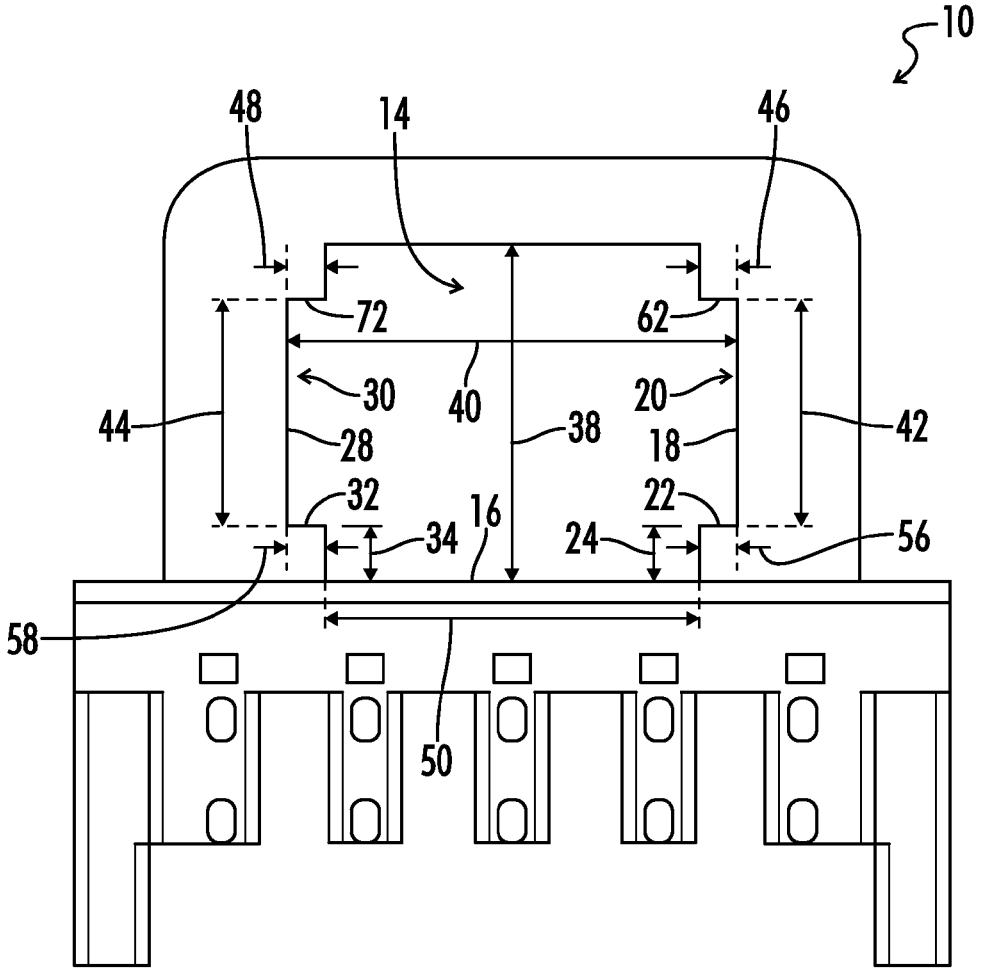
FIG. 2 is an end elevation view of an embodiment of the bobbin apparatus of FIG. 1.

Referring further to FIG. 1 and FIG. 2, bobbin body 10 includes a passage floor 16 located at the base of bobbin body substantially facing toward core passage 14. Passage floor 16 may have a substantially continuous surface in some embodiments, as illustrated in FIG. 1. In other embodiments, passage floor 16 may include one or more openings defined therein. Passage floor 16 may have a substantially flat surface in some embodiments. In other embodiments, passage floor 16 may have a curved, textured or otherwise non-flat shape for providing enhanced thermal or mechanical engagement with potting material disposed against passage floor 16.

A first passage wall 18, or first passage surface, extends upwardly from passage floor 16 and is positioned adjacent passage floor 16. A passage wall and passage floor, or any two passage surfaces, may be described as being adjacent one another when the two items of the same type (i.e. walls, major surfaces, etc.) are close to or nearby one another. A passage wall 18, 28, etc. and passage floor 16 may be described as being adjacent one another even when a core passage step 22, 32, etc. is located at the intersection of the wall 18, 28, etc. and floor 16. First passage wall 18 is generally positioned to be substantially facing toward core passage 14. As such, first passage wall 18 may be described as an interior wall, or an interior surface, on bobbin body 10 because first passage wall 18 is located on the interior of core passage 14 substantially facing inwardly toward the interior of core passage 14. In some embodiments, first passage wall 18 is generally oriented perpendicularly to passage floor 16. In other embodiments, first passage wall 18 may also be oriented at a non-perpendicular angle, or may have a curved orientation, relative to passage floor 16.

A second passage wall 28, or second passage surface, is also positioned adjacent passage floor 16 in some embodiments. Second passage wall 28 extends upwardly from passage floor 16 and is generally positioned opposite first passage wall 18 substantially facing toward core passage 14. Second passage wall 28 may be described as an interior wall, or interior surface, on bobbin body 10 because second passage wall 28 is located on the interior of core passage 14 substantially facing inwardly toward the interior of core passage 14. In some embodiments, second passage wall 28 is generally oriented perpendicularly to passage floor 16. In other embodiments, second passage wall 28 may be also oriented at a non-perpendicular angle or a curved orientation relative to passage floor 16.

Figure 3:
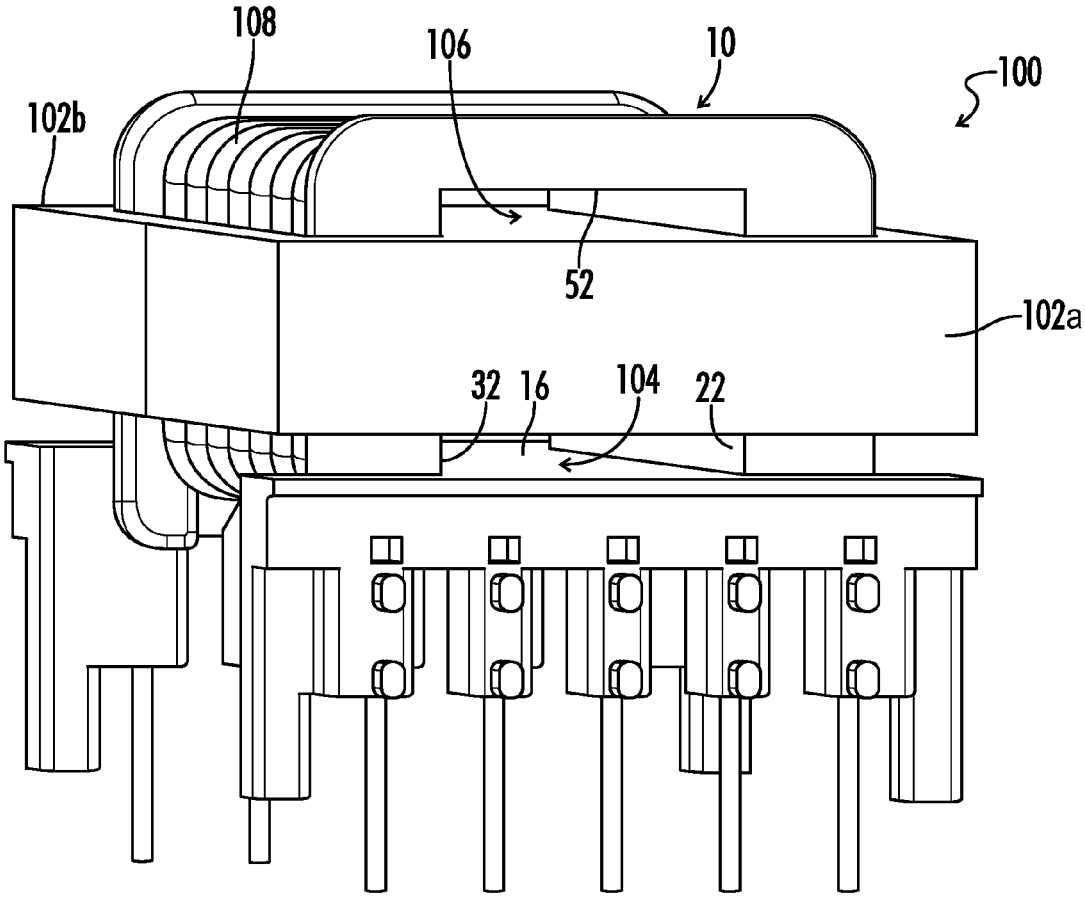
FIG. 3 is a perspective view of an embodiment of a magnetic component such as a transformer including a bobbin apparatus in accordance with the present invention.

Referring further to FIGS. 1-3, in some embodiments, a first step 22 is disposed on bobbin body 10 positioned between passage floor 16 and first passage wall 18. First step 22 may also be described as a shoulder formed integrally in bobbin body. For example, in some embodiments, bobbin body 10 is integrally molded from a suitable material such as a plastic, and first step 22 is formed as part of bobbin body 10 in a unitary, one-piece construction. In various other embodiments within the scope of the present invention, first step 22 may include a separate component that is installed into core passage 14 between first passage wall 18 and passage floor 16 following fabrication of bobbin body 10.

First step 22 provides a ledge protruding inwardly from first passage wall 18 generally toward core passage 14 in some embodiments. First step 22 may also be described as protruding upwardly from passage floor 16 generally toward core passage 14. First step 22 has a first step height 24 and a first step width 56, as seen in FIG. 2. First step height 24 is generally described as the distance between the passage floor 16 and the upper edge of first step 22. First step width 56 is generally described as the lateral width of first step 22, and in some embodiments may include the distance first step 22 protrudes laterally from first passage wall 28. In some embodiments, first step height 24 is greater than first step width 56. First step 22 has a continuous length substantially equal to the length of core passage 14, as seen in FIG. 1, in some embodiments. In various other embodiments, first step 22 has a discontinuous length less than the entire axial length of core passage 14. In some embodiments, first step 22 includes two or more sub-steps disposed along the axial length of core passage 14. Each first step 22 may be positioned at the intersection of first passage wall 18 and passage floor 16 between opposite axial ends of core passage 14 or may protrude directly from passage floor 16 without directly contacting an adjacent passage wall in various embodiments.

Referring further to FIG. 1 and FIG. 2, a second step 32 is positioned between passage floor 16 and second passage wall 28. Second step 32 may also be described as a second shoulder formed integrally in bobbin body. For example, in some embodiments, bobbin body 10 is integrally molded from a suitable material such as a plastic, and second step 32 is formed as part of bobbin body 10 in a unitary, one-piece construction. In various other embodiments within the scope of the present invention, second step 32 may include a separate component that is installed into core passage 14 between second passage wall 28 and passage floor 16 following fabrication of bobbin body 10.

Second step 32 provides a ledge protruding inwardly from second passage wall 28 generally toward core passage 14. Second step 32 may also be described as protruding upwardly from passage floor 16 generally toward core passage 14. Second step 32 has a second step height 34 and a second step width 58, as seen in FIG. 2. Second step height 34 is generally described as the distance between the passage floor 16 and the upper edge of second step 32. Second step width 58 is generally described as the lateral width of second step 32, and in some embodiments may include the distance second step 32 protrudes laterally from second passage wall 28. In some embodiments, second step height 34 is greater than second step width 58. Second step 32 has a continuous length substantially equal to the length of core passage 14 in some embodiments. In various other embodiments, second step 32 has a discontinuous length that is less than the entire axial length of core passage 14. Second step 32 may include two or more sub-steps disposed along the axial length of core passage 14. Second step 32 is positioned at the intersection of second passage wall 28 and passage floor 16 between opposite axial ends of core passage 14 in some embodiments.

First and second steps 22, 32 together provide a spaced platform for positioning a core, or a portion of a core such as a core leg, above passage floor 16, as seen in FIG. 3. For example, as seen in FIG. 2, in some embodiments, first and second steps 22, 32 are separated by a step separation distance 50. A core, or a portion of a core such as a core leg, having a local width greater than step separation distance 50 may be axially installed into core passage 14 such that a portion of the core rests on the upper edges of first and second steps 22, 32, as seen in FIG. 3. In some embodiments, first step height 24 and second step height 34 are substantially equal, providing a substantially level spaced platform. In additional embodiments, first and second step heights 24, 34 may be unequal, providing an angled platform.

Figure 7:
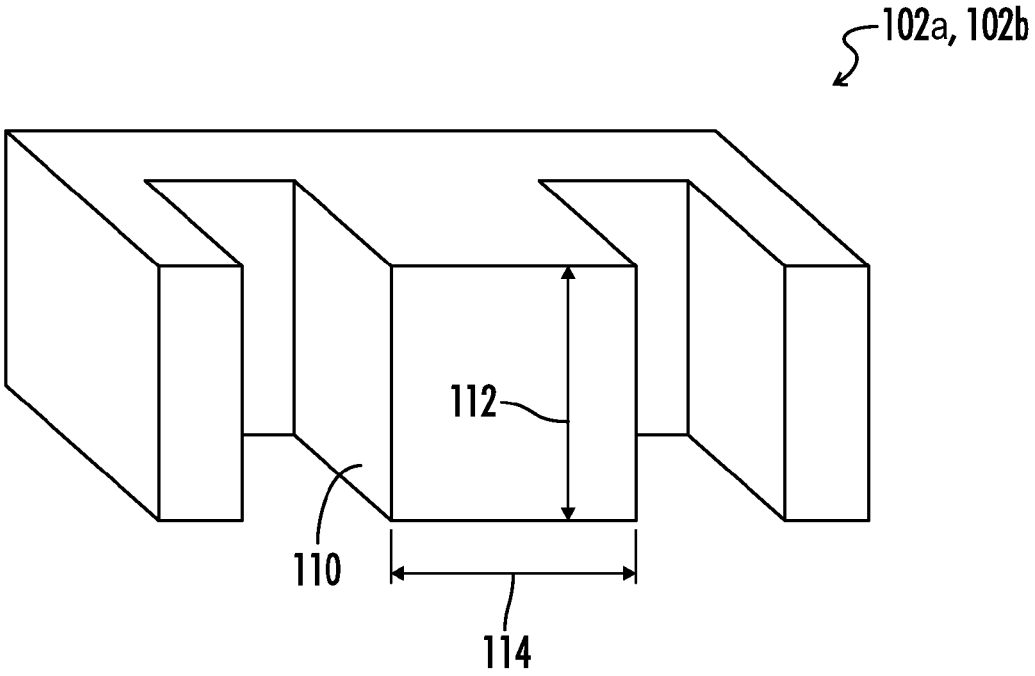
FIG. 7 is a perspective view of an embodiment of a core-half for use with a magnetic component in accordance with the present invention.

Referring further to FIG. 3, in some embodiments, the core includes a first core half 102*a* and a second core half 102*b*, each core half being installed axially into opposite ends core passage 14 on bobbin body 10 to form a magnetic component 100. As seen in FIG. 7, first and second core halves 102*a*, 102*b* may include a standard or modified E-core having a middle core leg 110. Middle core leg 110 has a middle core leg width 114 greater than step separation distance 50 in some embodiments.

A magnetic component 100, as seen in FIG. 3, may be formed when first and second core halves 102*a*, 102*b* are installed on bobbin body 10. Magnetic component 100 may be an inductor or a transformer in various embodiments. One or more conductive windings 108 are wound around bobbin body 10 on winding surface 12 to form a magnetic component 100 in some embodiments.

As seen in FIG. 3, a first gap 104 is defined between each core half 102*a*, 102*b* and passage floor 16. First gap 104 has a gap height substantially equal to first and second step heights 24, 34 in some embodiments.

First gap 104 provides a space for air flow in some embodiments of magnetic component 100 and may allow enhanced cooling of component 100. In additional embodiments, thermal transfer potting material may be disposed in first gap 104 between the core and core passage floor 116. The thermal transfer potting material helps to remove heat from the core and the inner windings on the bobbin body, thus reducing the temperature rise of the magnetic component 100.

In additional applications, the first gap 104 provides a space between the inner windings of the coil and the core and may keep the fringing flux created by a space or void between core halves inside the core passage from reaching the inner winding of the coil. For example, in some embodiments, the middle core legs 110 on adjacent, opposing cores 102*a*, 102*b*, may include an air void or space defined therebetween when both middle core legs 110 are located inside core passage 14. The air void or space between opposing core legs inside core passage 14 can be due to the length of one or both core legs. A fringing flux may be associated with the air space or void between the opposing core legs inside core passage 14. The negative effects of the fringing flux, including unwanted losses and increased temperature rise, can thus be mitigated in some embodiments by the presence of first gap 104 between the core halves 102*a*, 102*b* and passage floor 16.

Also seen in FIG. 3, in some embodiments, a second gap 106 may be formed between the core and the passage roof 52 on bobbin body 10. Passage roof 52 generally includes an interior surface on bobbin body that substantially faces downwardly toward axial core passage 14. Passage roof 52 is located between first and second opposing passage walls 18, 28 opposite passage floor 16.

In some embodiments, second gap 106 is formed by a space between passage roof 52 and the upper surface of first and second core halves 102*a*, 102*b*. Second gap 106 may be defined by third and fourth steps 62, 72 in bobbin body 10.

In some embodiments, a third step 62 is disposed between passage roof 52 and first passage wall 18. Third step 62 may also be described as a third shoulder formed integrally in bobbin body. For example, in some embodiments, bobbin body 10 is integrally molded from a suitable material such as a plastic, and third step 62 is formed as part of bobbin body 10 in a unitary, one-piece construction. In various other embodiments within the scope of the present invention, third step 62 may include a separate component that is installed into core passage 14 between first passage wall 18 and passage roof 52 following fabrication of bobbin body 10.

Third step 62 provides a ledge protruding inwardly from first passage wall 18 generally toward core passage 14 in some embodiments. Third step 62 may also be described as protruding downwardly from passage roof 52 generally toward core passage 14. Third step 62 has a third step height and a third step width 46, as seen in FIG. 2. In some embodiments, third step height is greater than third step width 46. Third step 62 has a continuous length substantially equal to the length of core passage 14 in some embodiments. In various other embodiments, third step 62 has a discontinuous length and may include two or more sub-steps positioned at the intersection of first passage wall 18 and passage roof 52 between opposite axial ends of core passage 14.

Referring further to FIG. 2, in some embodiments, a fourth step 72 is disposed between passage roof 52 and second passage wall 28. Fourth step 72 may also be described as a fourth shoulder formed integrally in bobbin body 10. For example, in some embodiments, bobbin body 10 is molded from a suitable material such as a plastic, and fourth step 72 is formed as part of bobbin body 10 in a unitary, one-piece construction. In various other embodiments within the scope of the present invention, fourth step 72 may include a separate component that is installed into core passage 14 between second passage wall 28 and passage roof 52 following fabrication of bobbin body 10.

Fourth step 72 provides a ledge protruding inwardly from second passage wall 28 generally toward core passage 14 in some embodiments. Fourth step 72 may also be described as protruding downwardly from passage roof 52 generally toward core passage 14. Fourth step 72 has a fourth step height and a fourth step width 48, as seen in FIG. 2. In some embodiments, fourth step height is greater than fourth step width 48. Fourth step 72 has a continuous length substantially equal to the length of core passage 14 in some embodiments. In various other embodiments, fourth step 72 may have a discontinuous length and may include two or more sub-steps positioned at the intersection of second passage wall 28 and passage roof 52 between opposite axial ends of core passage 14.

When core halves 102*a*, 102*b* are disposed on bobbin body 10 such that middle core legs 110 extend into core passage 14, the upper edge of each middle core leg 110 may engage third and fourth steps 62, 72 from below, thereby providing a second gap 106 between the core halves and the passage roof 52. Second gap 106 has a second gap height substantially the same as first gap height associated with first gap 104 in some embodiments. In various other embodiments, first and second gap heights may be different.

Second gap 106 may provide a similar function as first gap 104 in some applications. Second gap 106 provides a space for air flow in some embodiments and may allow enhanced cooling of component 100. In additional embodiments, thermal transfer potting material may be disposed in second gap 106 between the core and core passage roof 52.

In additional applications, second gap 106 provides space between the inner windings of the coil and the core and may keep the fringing flux created by the air space, or void, between opposing core legs inside core passage 14 from reaching the inner winding of the coil. The negative effects of the fringing flux, including unwanted losses and increased temperature rise, can thus be mitigated in some embodiments by the presence of second gap 106 between the core and passage roof 52.

Referring further to FIG. 2, in some embodiments, first and third steps 22, 62 may be alternatively described as being formed by the presence of a first groove 20 defined in first passage wall 18. First groove 20 generally has a rectangular cross-sectional profile extending between opposite axial ends of bobbin body 10. First groove 20 has a first groove height 42 which defines the vertical spacing between first step 22 and third step 62.

Also seen in FIG. 2, in some embodiments, second and fourth steps 32, 72 may be alternatively described as being formed by the presence of a second groove 30 defined in the second passage wall 28. Second groove 30 generally has a rectangular cross-sectional profile extending between opposite axial ends of bobbin body 10. Second groove 30 includes a second groove height 44 which defines the vertical spacing between second step 32 and fourth step 72.

Referring further to FIG. 2, the region of core passage 14 extending horizontally between first groove 20 and second groove 30 defines a passage width 40. In some embodiments, passage width 40 is substantially equal to or slightly greater than middle core leg width 114, seen in FIG. 7 and FIG. 8 in various embodiments. Similarly, in some embodiments, core passage 14 has a passage height 38 defined as the vertical distance between passage floor 16 and passage roof 52. In some embodiments, passage height 38 is greater than middle core leg height 112. In some embodiments first groove height 42 is substantially equal to or slightly larger than middle core leg height 112 such that a side of middle core leg 110 may be received in first groove 20. Similarly, second groove height 44 is substantially equal to or slightly larger than middle core leg height 112 such that the opposite side of middle core leg 110 may be received in second groove 30.

Figure 4:
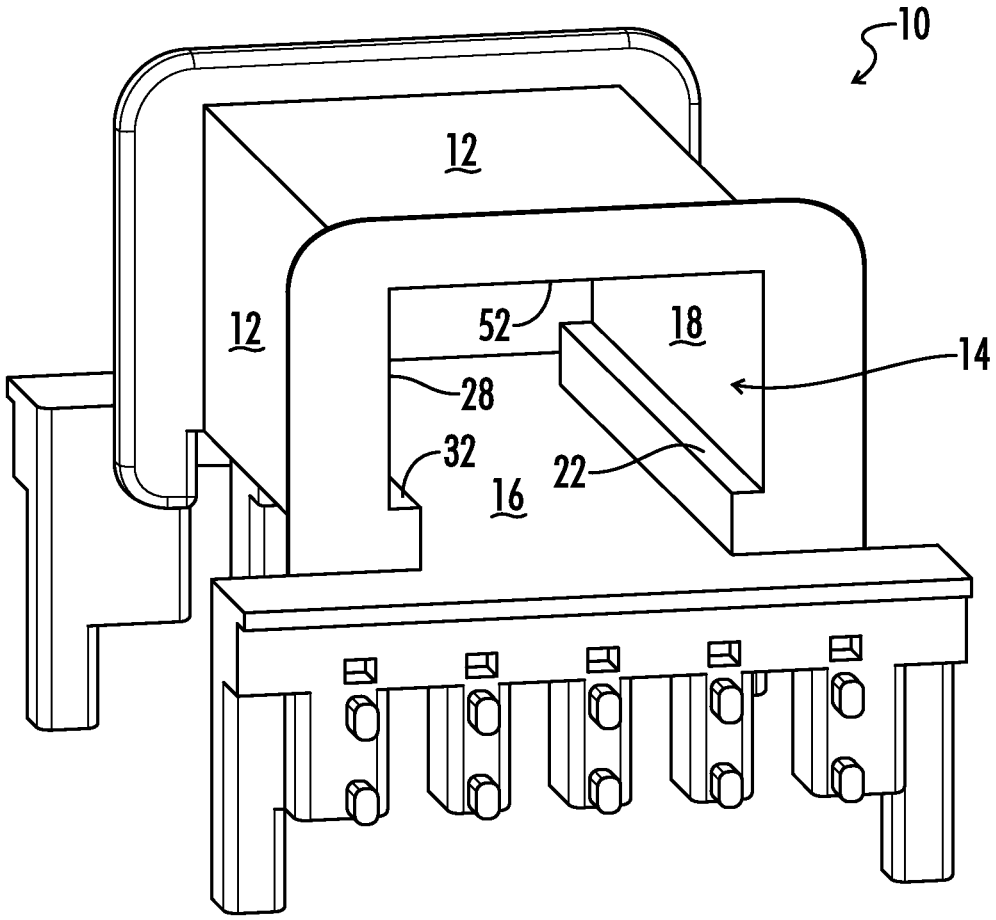
FIG. 4 is a perspective view of an alternative embodiment of a bobbin apparatus including a core passage step in accordance with the present invention.
Figure 5:
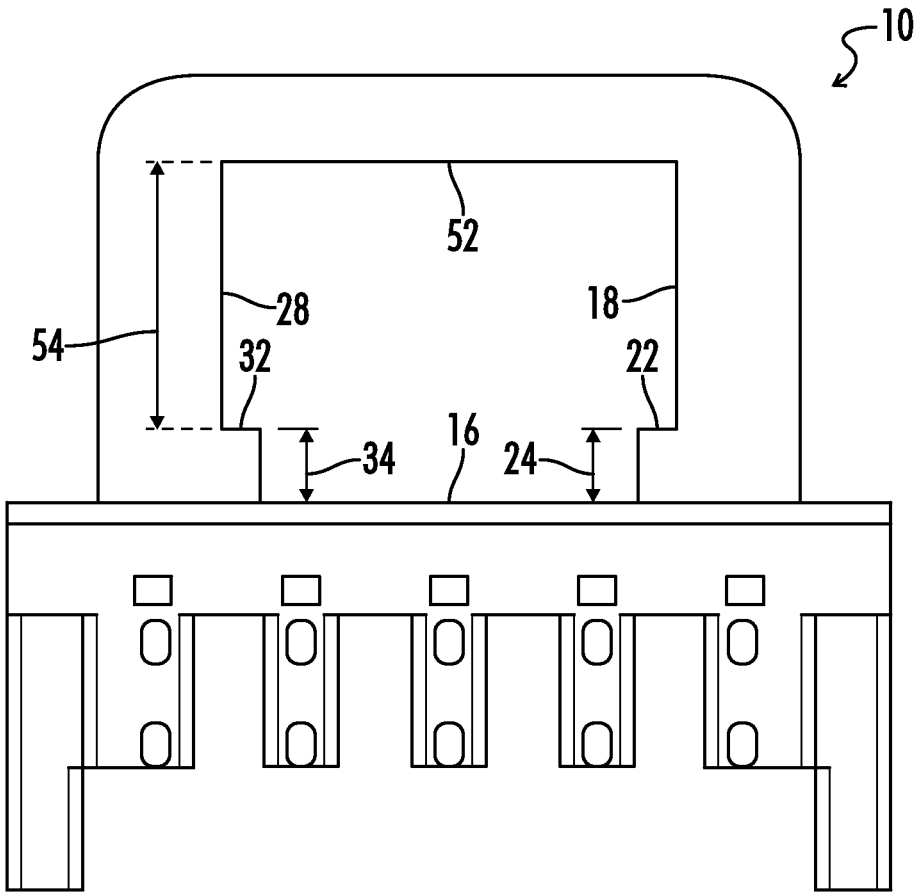
FIG. 5 is an end elevation view of an embodiment of the bobbin apparatus of FIG. 4.
Figure 6:
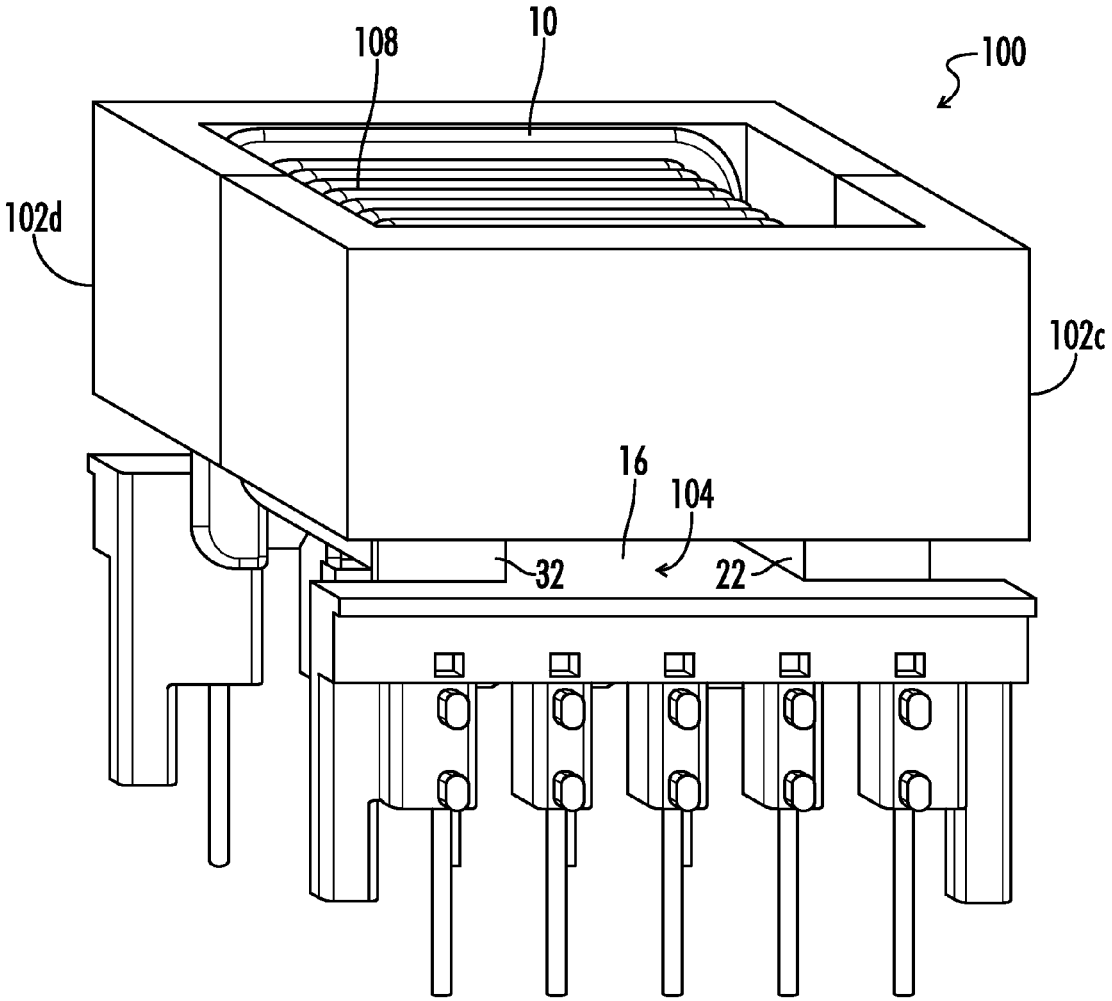
FIG. 6 is a perspective view of an embodiment of a magnetic component such as a transformer including a bobbin apparatus in accordance with the present invention.
Figure 8:
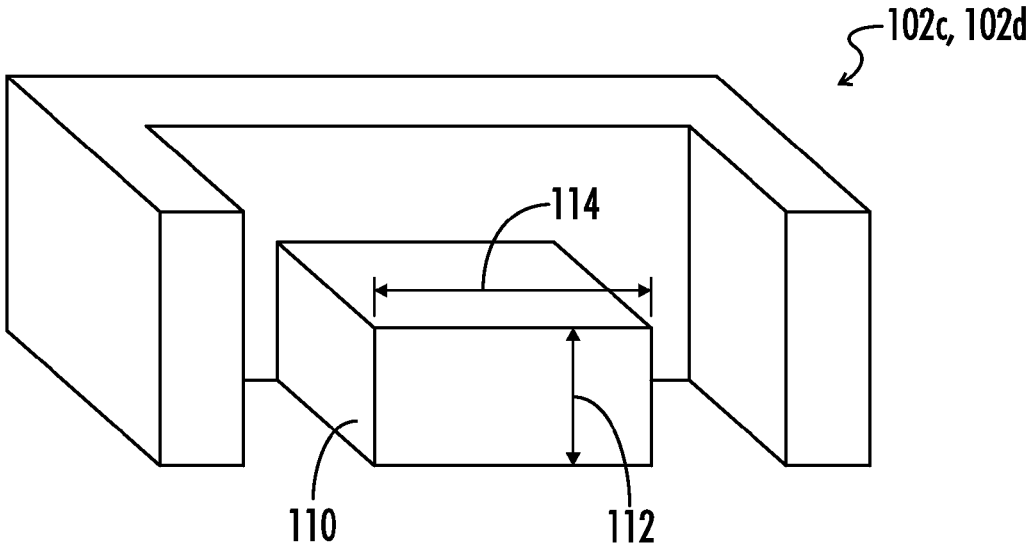
FIG. 8 is a perspective view of an alternative embodiment of a core-half for use with a magnetic component in accordance with the present invention.

Referring now to FIGS. 4-6, in some embodiments, a second embodiment of a bobbin apparatus includes a bobbin body 10 having first and second steps 22, 32 as described above. However, in some additional embodiments, no third step is present between first passage wall 18 and passage roof 52. Additionally, no fourth step is present in some embodiments between second passage wall 28 and passage roof 52. In such additional embodiments, bobbin body 10 is configured to accept various types of conventional cores. In some configurations, a pair of first and second modified E-core halves 102*c*, 102*d* seen in FIG. 6 may be installed on bobbin body 10. As seen in FIG. 8, the first and second modified E-core halves 102*c*, 102*d* include a middle core leg 110 having a middle core leg height 112 less than the height of the remainder of the core body. When the first and second modified E-core halves 102*c*, 102*d* are installed on bobbin body 10 opposing middle core legs 110 may extend into core passage 14, and middle core legs 110 rest on first and second steps 22, 32. In this configuration, the upper surface of each middle core leg 110 is located near passage roof 52. In some embodiments, the upper surface of each middle core leg 110 of first and second modified E-core halves 102*c*, 102*d* engage passage roof 52 when middle core legs 110 are installed in core passage 14. In such embodiments, passage height 54, seen in FIG. 5, extending upwardly between the tops of first and second steps 22, 32 and passage roof 52, is substantially equal to middle core leg height 112, seen in FIG. 8. In these embodiments, a first gap 104 is provided below first and second modified E-cores 102*c*, 102*d* between the cores and passage floor 16. Additionally, the upper surface of bobbin apparatus, including a winding 108 disposed thereon, may be substantially aligned with the plane of upper surfaces of the outer core legs on first and second modified E-core halves 102*c*, 102*d* on magnetic component 100.

In various other embodiments, the present invention also provides a method of assembling a magnetic component. The method includes the steps of: (a) providing a bobbin body having an axial core passage, a passage floor substantially facing toward the core passage, and at least one passage wall extending upwardly from the passage floor adjacent the passage floor, the bobbin body including at least one core passage step extending upwardly from the passage floor; (b) positioning a core in the core passage such that a portion of the core rests on the step, thereby forming a first gap between the passage floor and the portion of the core; and (c) introducing a potting material into the first gap.

In some embodiments, the core includes a first core half and a second core half, each core half including a middle core leg disposed in the core passage, an air space defined inside the core passage between the opposing middle core legs on the first and second core halves.

In additional embodiments, the method includes the bobbin body including a passage roof opposite the passage floor; forming a second gap between the core and the passage roof; and introducing a potting material into the second gap.

Thus, although there have been described particular embodiments of the present invention of new and useful CORE PASSAGE STEP APPARATUS AND METHODS, it is not intended that such references be construed as limitations upon the scope of this invention except as set forth in the following claims.

What is claimed is:

1. A magnetic component apparatus comprising:

a bobbin body having a first end and a second end;

a core passage defined axially through the bobbin body from the first end to the second end;

the bobbin body including a passage floor substantially facing toward the core passage, the passage floor defining a plane, the passage floor extending outward from the first and second ends of the bobbin body in the plane such that portions of the floor are outside the core passage;

a first passage wall extending upwardly from the passage floor substantially facing toward the core passage; and a first step disposed on the bobbin body at the intersection of the passage floor and the first passage wall, the first step terminating at the first end and at the second end of the bobbin body such that no portion of the first step extends out of the core passage;

a core leg disposed in the core passage, the core leg resting on the first step, the core leg defining a gap between the core leg and the passage floor; and a thermal transfer potting material disposed in the gap in thermal contact with the core leg to transfer heat from the core leg.

2. The apparatus of claim 1, wherein:

the first step has a continuous length extending the axial length of the core passage.

3. The apparatus of claim 1, further comprising:

a second passage wall opposite the first passage wall, the second passage wall extending upwardly from the passage floor substantially facing toward the core passage.

4. The apparatus of claim 3, further comprising:

a second step disposed on the bobbin body at an intersection of the passage floor and the second passage wall, the second step protruding upwardly from the passage floor a second step height, the second step terminating at the first end and at the second end of the bobbin body such that no portion of the second step extends out of the core passage.

5. The apparatus of claim 4, wherein:

the second step has a continuous length extending the axial length of the core passage.

6. The apparatus of claim 4, further comprising:

a passage roof opposite the passage floor between the first and second passage walls facing substantially downwardly toward the core passage; and a third step disposed on the bobbin body at an intersection of the first passage wall and the passage roof, wherein the third step protrudes downwardly from the passage roof.

7. The apparatus of claim 3, further comprising:

a passage width defined as the distance between the first and second passage walls; and the core leg having a core leg width equal to the passage width.

8. The apparatus of claim 6, further comprising:

a fourth step disposed on the bobbin body at the intersection of the second passage wall and the passage roof, wherein the fourth step protrudes downwardly from the passage roof.

9. The apparatus of claim 3, further comprising:

a passage roof positioned opposite the passage floor between the first and second passage walls facing substantially toward the core passage;

a passage height defined as the distance between the first step and the passage roof; and the core leg having a core leg height substantially equal to the passage height.

10. A magnetic component apparatus, comprising:

a bobbin body including a winding surface, the bobbin body having a first end and a second end;

a core passage defined axially through the bobbin body from the first end to the second end, the core passage defining a core passage interior;

a passage floor formed on the bobbin body substantially facing upwardly toward the core passage interior, the passage floor defining a plane, the passage floor extending outward from the first and second ends of the bobbin body in the plane such that portions of the floor are outside the core passage;

a first passage wall formed on the bobbin body adjacent the passage floor, the first passage wall facing substantially toward the core passage interior;

a second passage wall formed on the bobbin body adjacent the passage floor, the second passage wall positioned opposite the first passage wall and facing substantially toward the core passage interior, a passage width defined between the first and second passage walls;

a first step protruding upwardly from the passage floor at the intersection of the passage floor and the first passage wall, the first step terminating at the first end and at the second end of the bobbin body such that no portion of the first step extends out of the core passage;

a second step protruding upwardly from the passage floor at the intersection of the passage floor and the second passage wall, the second step terminating at the first end and at the second end of the bobbin body such that no portion of the second step extends out of the core passage;

a core leg positioned in the core passage, the core leg defining a core leg width, the core leg resting on the first step and the second step with a first gap defined between the core and the passage floor; and a thermal transfer potting material disposed in the first gap.

11. The apparatus of claim 10, further comprising:

a passage roof located on the bobbin body between the first and second side passage walls, the passage roof facing substantially downwardly toward the core passage interior opposite the passage floor.

12. The apparatus of claim 11, further comprising:

the core leg including a core leg height; and the bobbin body including a passage height defined as the shortest distance between the first step and the passage roof.

13. The apparatus of claim 12, wherein:

the core leg height is substantially equal to the passage height.

14. The apparatus of claim 10, further comprising:

a step separation distance defined as the distance between first and second steps, wherein the core leg width is greater than the step separation distance.

15. The apparatus of claim 10, wherein the passage width is substantially equal to the core leg width.

16. A method of assembling a transformer, comprising:

(a) providing a bobbin body having an axial core passage extending between a first end and a second end of the bobbin body, a passage floor substantially facing toward the core passage, the passage floor defining a plane, the passage floor extending outward from the first and second ends of the bobbin body in the plane such that portions of the floor are outside the axial core passage, and at least one passage wall extending upwardly from the passage floor adjacent the passage floor, the bobbin body including at least one core passage step extending upwardly from the passage floor at the intersection of the passage floor and the passage wall, the at least one core passage step terminating at the first end and at the second end of the bobbin body such that no portion of the first step extends out of the core passage;

(b) positioning a core in the core passage such that a portion of the core rests on the step, thereby forming a first gap between the passage floor and the portion of the core; and (c) introducing a thermal transfer potting material into the first gap in thermal contact with the core leg to transfer heat from the core leg.

17. The method of claim 16, wherein:

the core includes a first core half and a second core half, each core half including a middle core leg disposed in the core passage, an air space defined inside the core passage between the opposing middle core legs on the first and second core halves.

18. The method of claim 16, further comprising:

the bobbin body including a passage roof opposite the passage floor;

forming a second gap between the core and the passage roof; and introducing a potting material into the second gap.

19. A magnetic component apparatus comprising:

a bobbin body having a first end and a second end;

a core passage defined axially through the bobbin body from the first end to the second end, the core passage having an axial length;

the bobbin body including a passage floor substantially facing toward the core passage, the passage floor defining a plane, the passage floor extending outward from the first and second ends of the bobbin body in the plane such that portions of the floor are outside the core passage;

a first passage wall extending upwardly from the passage floor substantially facing the core passage, the first passage wall terminating at the first end and at the second end of the bobbin body such that no portion of the first passage wall extends out of the core passage;

a second passage wall extending upwardly from the passage floor opposite the first passage wall and substantially facing the core passage, the second passage wall spaced apart from the first passage wall by a passage wall separation distance, the second passage wall terminating at the first end and at the second end of the bobbin body such that no portion of the second passage wall extends out of the core passage;

a first groove defined in the first passage wall, wherein:

the first groove extends the axial length of the core passage between the first end and the second end of the bobbin body;

the first groove extends into the first passage wall by a first groove depth to a first groove surface; and the first groove has a first groove height;

a second groove defined in the second passage wall, wherein:

the second groove extends the axial length of the core passage between the first end and the second end of the bobbin body;

the second groove extends into the second passage wall by a second groove depth to a second groove surface; and the second groove has a second groove height;

a core leg disposed in the first and second grooves, the core leg having a core leg width substantially equal to a passage width, the passage width comprising a sum of the passage wall separation distance, the first groove depth and the second groove depth, so that the core leg extends substantially from the first groove surface to the second groove surface, the core leg spaced apart from the passage floor to form a gap therebetween; and a thermal transfer potting material disposed in the gap.

20. The apparatus of claim 19, wherein the first and second groove heights are substantially equal.

21. The apparatus of claim 20, further comprising:

the core leg having a core leg height substantially equal to the first and second groove heights.

* * * * *